United States Patent [19]

Marshall et al.

[11] 4,019,990

[45] Apr. 26, 1977

[54] PRODUCTION OF POLYESTER TIRE YARN POLYGLYCOL ETHER SPIN FINISH COMPOSITION

[75] Inventors: Robert Moore Marshall, Chester; Kimon Constantine Dardoufas, Richmond, both of Va.

[73] Assignee: Allied Chemical Corporation, Morris Township, N.J.

[22] Filed: July 23, 1975

[21] Appl. No.: 598,465

[52] U.S. Cl. ..... 252/8.9; 252/8.6; 57/157 S; 264/210 F

[51] Int. Cl.[2] ..... D06M 15/10

[58] Field of Search ..... 252/8.9; 57/157 S; 252/8.6; 264/210 F

[56] References Cited

UNITED STATES PATENTS 3,850,658 11/1974 Gomez et al. ..... 252/8.8

3,919,097 11/1975 Park ..... 252/8.9

*Primary Examiner*—Allan Lieberman

*Attorney, Agent, or Firm*—Fred L. Kelly

[57] ABSTRACT

It has been suggested that certain polyglycol ethers, in particular mixed polyoxyethylated-polyoxypropylated monoethers, are useful as spin finishes in the production of polyester tire yarns. Polyglycol ethers having a relatively low molecular weight of about 300 to 1,000 make the best lubricants; however, their effectiveness is significantly diminished by volatilization loss during high temperature processing of the tire yarn. It has now been found that said volatilization loss is greatly decreased by including in the finish a small percentage of certain antioxidant compounds. The particular antioxidant compound used has been found to be very critical.

1 Claim, No Drawings

PRODUCTION OF POLYESTER TIRE YARN POLYGLYCOL ETHER SPIN FINISH COMPOSITION

CROSS REFERENCES TO RELATED APPLICATIONS

This application is related to our U.S. application Ser. No. 589,974, filed June 24, 1975.

BACKGROUND OF THE INVENTION

This invention relates to multifilament polyester yarns. More particularly, it relates to an improved multifilament polyester yarn and a new fiber finishing process for polyester yarns in which novel fiber finish compositions are applied to said yarns. Still more particularly, it relates to a fiber finish composition designed specifically for tire cord processing for polyethylene terephthalate yarns.

Many fiber finish compositions are known. Some are quite specific in composition and relate to specific type fibers. Small changes in fiber finish composition frequently result in tremendous improvements in not only processing but also in end use of the fiber.

Polyester tire yarn finishes generally consist of a combination of a lubricant, an antistat, and several emulsifiers. For example, U.S. Pat. No. 3,687,721 discloses an improved polyester tire yarn treated with a composition comprising decaglycerol tetraoleate, glycerol monooleate, ethoxylated tall oil fatty acid, sulfated glycerol trioleate, ethoxylated alkylamine and hexadecyl stearate. Obviously, maintaining the proper ratio of lubricant, antistat and emulsifiers is essential for consistent performance of the tire yarn.

U.S. Pat. No. 2,425,755 discloses novel mixtures of monohydroxy oxyethylene-oxy-1,2-propylene aliphatic monoethers and methods of making such mixtures. This patent states that said mixtures can serve as textile lubricants to give a more desirable "hand" to synthetic fibers; however, the patent does not teach a suitable method for using the products as a spin finish.

U.S. Pat. No. 3,338,830 discloses textile lubricating compositions comprising polyoxyethylated-polyoxypropylated monoethers of exceedingly high molecular weight, e.g., 5,000 or more. This patent teaches that said polyoxyalkylene textile lubricating compositions must contain as essential ingredients a suitable emulsifier and a lubricating ester compound.

Applicants have found that certain polyglycol ethers, particularly mixed polyoxyethylated-polyoxypropylated monoethers, having a relatively low molecular weight of about 300 to 1,000 make the best lubricants when used in a spin finish for the production of polyester tire yarns. Moreover, these polyglycol ethers can be used directly without dilution with water and/or addition of an emulsifier and a lubricating ester compound. Unfortunately, the effectiveness of these lower molecular weight polyglycol ethers as spin finishes is significantly diminished by volatilization loss during high temperature processing of tire yarn. Clearly, it would be a significant advance in this art to find a method to avoid or significantly decrease this volatilization loss.

SUMMARY OF THE INVENTION

Accordingly, it is a primary object of this invention to provide a textile treating composition suitable for the preparation of tire yarn in a high temperature process.

It is another object of this invention to provide a method of finishing polyester tire yarn which results in an improved compression-extension durability of the fiber in rubber.

These and other objects are accomplished in accordance with the process of the present invention which is briefly stated as follows:

In a process for producing polyester yarn wherein a liquid finish is applied to the yarn, said process involving spinning and drawing steps, the improvement comprising first applying to the yarn prior to said drawing step from about 0.2 to about 1.5 weight percent based on the weight of the yarn of a finish composition consisting essentially of about 0.5 to 3 parts by weight of an antioxidant compound having the formula:

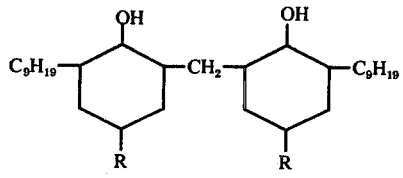

wherein R is selected from the group consisting of H and alkyl groups having 1 to 4 carbon atoms; and about 97 to 99.5 parts by weight of a polyalkylene glycol compound having the formula:

$$R—(O\text{-}R_1—O\text{-}R_2)_n—OH$$

in which $R_1$ and $R_2$ are the same or different alkylene units having up to 4 carbon atoms, R is an alkyl group containing 1 to 8 carbon atoms and $n$ has a value to produce a molecular weight of 300 to 1,000, and then heating said yarn after said drawing step at a temperature between about 135° C. and 230° C.

It is noteworthy that the present finish can be applied directly to the yarn; however, if desired, the finish composition may be diluted with water to a water content up to about 50 weight percent of the diluted composition. The finish composition is applied to polyester yarns including, for example, polyethylene terephthalate yarns by any known means including bath, spray, padding, kiss roll application or the like. It is important that at least 90 percent of the polyalkylene glycol compound is retained on the yarn during the processing steps. The yarn is made into tire cord by known procedures and thereafter tensilized by heating at a temperature of from about 200° C. to 230° C. to improve heat stability.

Certain terms referred to within the specification are defined below.

"Disc fatigue" is defined and described in scope, principle and testing procedure as follows:

This test is used to determine the ability of a textile tire cord to resist degradation when subjected to repeated cycles of compression and extension.

The disc fatigue tester cyclically compresses and extends cord specimens that have been embedded in rubber blocks. After a specified number of compression and extension cycles, the cords are removed from the blocks and tested for tensile strength. The strength of these cords is then compared with that of similar cords that have been cured in rubber but have not been fatigued. The results are then reported in percent strength retained. This method is more specifically described in U.S. Pat. No. 2,595,069.

DESCRIPTION OF THE PREFERRED EMBODIMENT

The preferred polyalkylene glycol compounds of the present invention are so-called random copolymers, preferably, random copolymers made from ethylene oxide and propylene oxide. Ethylene oxide and propylene oxide are reacted simultaneously to form mixed polyalkylene glycol compounds. For example, with alcohols, mixed polyoxyethylated-polyoxypropylated monoethers result in accordance with the following equation:

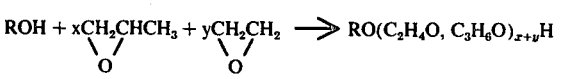

where R is as described above, where $x$ is the number of moles of propylene and $y$ is the number of moles of ethylene oxide. We prefer to use such compounds which are condensation products of 40 to 60 percent ethylene oxide and 40 to 60 percent propylene oxide on a mol basis, terminated with an alcohol containing 3 to 5 carbon atoms. Typical prior art in this field includes U.S. Pat. No. 2,425,755 and U.S. Pat. No. 2,425,845.

Polyalkylene glycols and their derivatives made by such procedures are sold under the trade-name Ucon (Union Carbide Corporation). The code number after the series designation indicates the viscosity at 100° F. in Saybolt universal seconds (S.U.S.) in the Ucon series. All members of the Ucon 50-HB and Ucon 75-H series are water-soluble while the Ucon LB and Ucon D series are water-insoluble. For use in the present invention, the water-soluble compounds are preferred. Optimum results have been obtained with polyoxyethylated-polyoxypropylated monoethers which are condensation products of 50 percent ethylene oxide and 50 percent propylene oxide terminated with butyl alcohol said monoethers having a viscosity of 75–300 S.U.S., preferably 100 to 200 S.U.S.

Preferred antioxidant compounds are those having the formula:

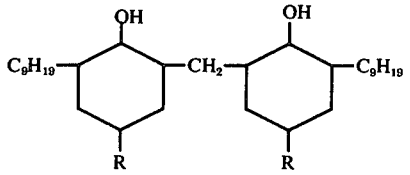

wherein R is an alkyl group having 1 to 3 carbon atoms. Some of these compounds are commercially available. For example, 2,2′-methylene-bis(4-methyl-6-nonyl phenol) is commercially available from Uniroyal Chemical; a division of Uniroyal Incorporated.

In addition to the critical nature of the finish composition, it has also been found that heat treatment of the yarn subsequent to the application of the finish composition and drawing of the yarn is likewise critical for achieving optimum results in accordance with the invention. The use of too high a temperature of heat treatment will cause fusion of the fibers as well as causing a drop in strength properties. The maximum temperature will be governed by the melting point of the particular fibers used. Normally, less than 10 percent of the finish composition applied to the yarn is volatilized during normal heat treatment of the yarn on heated rolls maintained at about 135° C. to 230° C.

The product yarn of the process of the present invention may be twisted and plied into greige cord. The resulting cords are then tensilized in a conventional tensilization procedure. The time-temperature relationship of the tensilization heat treatment must be carefully controlled so that the fiber properties do not suffer impairment. Too long a treatment, even at preferred temperatures will tend to degrade the fibers. Normally, the heat treating step will be carried out so that the surface of the fibers will be raised rapidly to a temperature of 200° to 230° C., preferably 215° C. to 230° C. and kept at that temperature for up to 160 seconds. A satisfactory criterion for determining the best time/temperature relationship is to measure the heat stability of the fiber, both heat treated and untreated. Of course, the heat treatment should significantly improve the heat stability of the fiber. Any means for heating the surface of the fiber may be used and a large variety of suitable apparatus is available in the trade.

In order to demonstrate the invention, the following examples are given. They are provided for illustrative purposes only and are not to be construed as limiting the scope of the invention, which is defined by the appended claims.

EXAMPLE 1

This example demonstrates that the finish of the present invention can be used with excellent results as a spin finish in a conventional spin-draw process for producing polyethylene terephthalate yarn. The polyoxyalkylated monoether used was a condensation product of 50 percent ethylene oxide and 50 percent propylene oxide terminated with butyl alcohol and having a molecular weight of about 570 and a viscosity of 100 S.U.S. at 100° F. About 99 parts by weight of this polyoxyalkylated monoether was mixed with about 1 part by weight of 2,2′-methylene-bis-(4-methyl-6-nonyl phenol) to form the finish composition. This finish was applied directly, i.e., without diluting with water, as a spin finish to polyethylene terephthalate tire yarn approximately 1300 denier, 192 filaments) by means of a kiss roll prior to drawing the yarn. After drawing, the yarn was heated to 135°–230° C. on relax rolls. Less than 9 percent of the finish was volatilized during this heating step. The finished yarn was readily twisted and plied into greige cord. The resulting cords were then tensilized by a conventional tensilization procedure. To show the effect of application rate, the application level ranged from 0.2 percent to 1.5 percent based on the weight of fiber. Yarns with finish levels from 0.5 percent to 1.0 percent were considered most desirable in view of relatively low finish required and significantly improved compression-extension durability in rubber as tested in the above-described disc fatigue test where the percent strength retention is recorded. The results are shown in Table I.

TABLE I

| Percent Finish on Yarn | Disc Fatigue % B.S. Retained |
|---|---|
| 0.2 | 76 |
| 0.5 | 86 |
| 0.8 | 92 |
| 1.0 | 93 |
| 1.5 | 94 |

In a comparative test, a tire yarn prepared with a spin finish and an overfinish in accordance with U.S. Pat. No. 3,672,977 showed 77 percent strength retention at finish levels of from 0.83 to 1.25 percent based on the weight of fiber.

EXAMPLE 2

The procedure of Example 1 was followed except that the amount of 2,2′-methylene-bis-(4-methyl-6-nonyl phenol) in the spin finish was varied to show the effect upon the amount of finish volatilized from the yarn at yarn temperatures up to about 150° C. The results are shown in Table II. The individual standard deviation ($\sigma$) of the test was about 1 percent so that a difference of 3 percent or more in the amount of finish volatilized is highly significant.

TABLE II

| Percent of 2,2′-methylene-bis-(4-methyl-6 nonyl phenol) in Finish | Percent of Finish Volatilized |
|---|---|
| 3 | 8 |
| 1 | 9 |
| 0.5 | 15 |
| 0 | 21 |

From these data, the preferred amount of the 2,2′-methylene-bis-(4-methyl-6-nonyl phenol) in the finish is about 1-3 percent by weight.

EXAMPLE 3

Since 2,2′-methylene-bis-(4-methyl-6-nonyl phenol) is sold commercially as an antioxidant compound, a number of other commercially available antioxidants were tested to determine their effectiveness in prevention of volatilization loss. In these tests, the procedure of Example 1 was followed except that an equal weight of the antioxidant tested was substituted for the 2,2′-methylene-bis-(4-methyl-6-nonyl phenol) used in Example 1. The results are shown in Table III. The individual standard deviation ($\sigma$) of the test was about 1 percent so that a difference of 3 percent or more in the amount of finish volatilized is highly significant.

TABLE III

| Antioxidant Used in Finish | Percent of Finish Volatilized |
|---|---|
| None | 21 |
| dibeta naphthyl phenylene | 21 |
| phenyl-beta-naphthylamine | 22 |
| hydroquinone monobenzyl ether | 19 |
| trinonyl phenol phosphite | 21 |
| phosphate ester of hindered hydroquinone | 19 |
| 2,2′-methylene-bis-(4-methyl 6-nonyl phenol) | 9 |

It is apparent from these data that the particular antioxidant compound added to the spin finish composition is very critical in terms of the present finish volatilized in processing of the yarn.

We claim:

1. A finish composition for yarn consisting essentially of about 0.5 to 3 parts by weight of an antioxidant compound having the formula:

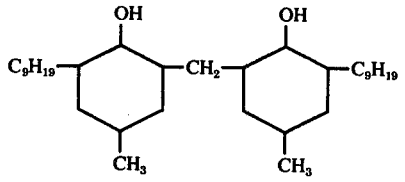

and about 97 to 99.5 parts by weight of a polyalkylene glycol compound which is a mixed polyoxyethylated-polyoxypropylated monoether prepared in accordance with the equation $$ROH + x\underset{\diagdown O \diagup}{CH_2CHCH_3} + y\underset{\diagdown O \diagup}{CH_2CH_2} \longrightarrow RO(C_2H_4O, C_3H_6O)_{x+y}H$$

where R is an alkyl group having 3 to 5 carbon atoms, $x$ and $y$ are the number of moles of propylene oxide and ethylene oxide, respectively, and wherein ethylene oxide comprises 40 to 60 percent of the combined total of ethylene oxide and propylene oxide and $x + y$ has a value to produce a molecular weight of from 300 to 1,000.

* * * * *